US009649002B1

(12) United States Patent
Pollack et al.

(10) Patent No.: US 9,649,002 B1
(45) Date of Patent: May 16, 2017

(54) HIGH DUMP FLOOR SCRUBBER SWEEPER

(71) Applicant: Minuteman International, Inc., Hampshire, IL (US)

(72) Inventors: Jeffrey W. Pollack, Joliet, IL (US); Christopher M. Knowlton, Pinehurst, NC (US)

(73) Assignee: Minuteman International, Inc., Hampshire, IL (US)

( * ) Notice: Subject to any disclaimer, the term of this patent is extended or adjusted under 35 U.S.C. 154(b) by 23 days.

(21) Appl. No.: 14/993,820

(22) Filed: Jan. 12, 2016

(51) Int. Cl.
*A47L 11/30* (2006.01)
*A47L 11/40* (2006.01)

(52) U.S. Cl.
CPC ..... *A47L 11/305* (2013.01); *A47L 11/4016* (2013.01); *A47L 11/4025* (2013.01); *A47L 11/4038* (2013.01); *A47L 11/4044* (2013.01); *A47L 11/4055* (2013.01); *A47L 11/4061* (2013.01); *A47L 11/4083* (2013.01); *A47L 11/4088* (2013.01)

(58) Field of Classification Search
CPC A47L 11/305; A47L 11/4061; A47L 11/4083; A47L 11/4088; A47L 11/4016; A47L 11/4044; A47L 11/4055; A47L 11/4025; A47L 11/4038
USPC ..... 15/340.1, 340.3, 340.4
See application file for complete search history.

(56) References Cited

U.S. PATENT DOCUMENTS 5,802,665 A 9/1998 Knowlton et al.
7,448,114 B2 11/2008 Basham et al.

*Primary Examiner* — David Redding
(74) *Attorney, Agent, or Firm* — Greer, Burns & Crain, Ltd.

(57) ABSTRACT

A mobile floor scrubber sweeper includes operator and engine compartments, clean solution and reclaimed dirty solution tanks, and a clean solution delivery system for applying clean solution to a floor ahead of a pair of counter-rotating cylindrical scrub/sweep brushes. Also included are a debris hopper coupled to a first lift system for moving the debris hopper between an operating position within the scrubber sweeper and an elevated aft position for discharging debris/dirty solution into an external debris container, and a rear squeegee coupled to a second lift system for independently moving the rear squeegee from a lowered, floor engaging, operating position to an elevated non-use position to facilitate squeegee inspection, adjustment, maintenance or replacement, without moving the debris hopper. The hopper and squeegee lift systems operate independently of one another, and the hopper lift system is compatible with standard high, i.e., sixty (60) inch, debris containers.

20 Claims, 16 Drawing Sheets

HIGH DUMP FLOOR SCRUBBER SWEEPER

FIELD OF THE INVENTION

This invention relates generally to mobile floor scrubber sweepers and is particularly directed to an arrangement in a mobile floor scrubber sweeper having a debris hopper and a squeegee, wherein the debris hopper and squeegee are independently and individually movable between a lowered operating position and a range of elevated positions for (1) emptying the hopper into a high debris container, or for (2) inspection, adjustment, maintenance and replacement of the squeegee.

BACKGROUND OF THE INVENTION

In typical floor care operations, a dedicated floor sweeper is used to remove dry fine and bulky solid debris from the floor. When necessary, a dedicated floor scrubber trails the sweeper to scrub the floor to a shiny finish. As typically happens between the time the sweeper has completed a pass and the arrival of the scrubber, additional debris is deposited on the floor. When the dedicated floor scrubber passes over this later deposited debris, the debris is engaged by and gets caught in the rear squeegee in the scrubber, reducing the performance of the squeegee by causing solution loss and floor streaking. In addressing this problem, combined scrubber sweepers have been developed that are essentially a floor scrubbing machine which is also provided with a limited sweeping capability. These combined machines use the rotating rear cylindrical scrub brush, or brushes, as a sweeping broom which picks up solid debris and directs the debris into a hopper. This arrangement prevents solid debris from becoming trapped in the rear squeegee causing the aforementioned solution loss and streaking on the floor.

In many combined scrubber sweeper machines, the debris hopper is manually removed from the machine, lifted to a raised position, and emptied by hand into a debris dumpster. The substantial weight of wet debris limits the maximum capacity of debris hoppers emptied by hand. In some cases, the debris hopper of the scrubber sweeper machine is in the form of two separate hoppers to facilitate manual lifting and emptying of each hopper. The manual lifting and emptying of a debris hopper is particularly a problem when attempting to empty the debris hopper into a standard high debris dumpster which is typically on the order of sixty (60) inches high.

To provide larger debris hopper capacity for increasing scrubber sweeper machine productivity by increasing the time between the required emptying of the debris hopper, high dump scrubber sweepers have been developed which incorporate powered debris emptying systems. These systems typically have the ability to raise the hopper to a sufficient height for emptying into standard 60" high debris dumpsters. In these types of combined scrubber sweeper cleaning machines, the aft squeegee operates to retain water between itself and a front squeegee, where it is vacuumed up through a vacuum port. The rear squeegee is typically comprised of rubber and operates as a seal as it is dragged against the floor, tending to wear out and require replacement. This characteristic necessitates frequent inspection, adjustment, maintenance and replacement of the rear rubber squeegee. This presents a problem in existing scrubber sweeper machines as removing and replacing the rear rubber squeegee in a scrubber sweeper mounting structure is quite awkward and time consuming. This presents an efficiency/ productivity problem because of the necessity for frequent inspection, adjustment, maintenance and replacement of the rear rubber squeegee.

The present invention addresses the aforementioned problems of the prior art by providing for the powered, independent movement of the scrubber sweeper's debris hopper and the scrubber sweeper's rear squeegee between a lowered operating position and a range of elevated positions to facilitate either emptying of the debris hopper into a debris dumpster as high as 60" dumpster, or higher, or inspection, adjustment, maintenance and possible removal and replacement of the squeegee.

OBJECTS AND SUMMARY OF THE INVENTION

Accordingly, it is in an object of the present invention to provide a mobile high dump floor scrubber sweeper with separate displacement systems for raising and lowering the scrubber sweeper's debris hopper and squeegee assembly independently from one another.

It is another object of the present invention to provide the capability in a mobile floor scrubber sweeper having a floor squeegee assembly to move the squeegee assembly between a lowered use position within the scrubber sweeper and an elevated non-use position which is displaced from the sweeper assembly and other components and assemblies of the scrubber sweeper for facilitating inspection, adjustment, maintenance and replacement of the squeegee.

Yet another object of the present invention is to provide a first lift system in a mobile floor scrubber for lifting the scrubber sweeper's debris hopper to an elevated position for discharge of the debris into a high debris dumpster debris, and a second lift system for lifting the scrubber sweeper's rear squeegee from the floor to an elevated position spaced from the debris hopper to facilitate inspection, adjustment, maintenance and replacement of the squeegee.

More particularly, the present invention is directed to an industrial rider scrubber sweeper used to clean floors. The scrubber sweeper is equipped with an operator compartment, an engine compartment, a cleaning solution tank, a solution delivery system that applies cleaning solution to the floor ahead of one or more rotating cylindrical scrub brushes, a debris hopper located directly behind the scrub brushes, a first powered debris hopper lift system, a rear squeegee assembly, and a second squeegee lift system for raising the squeegee over a range of elevated positions to facilitate squeegee inspection, adjustment, maintenance and replacement without interference with an elevated debris hopper.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
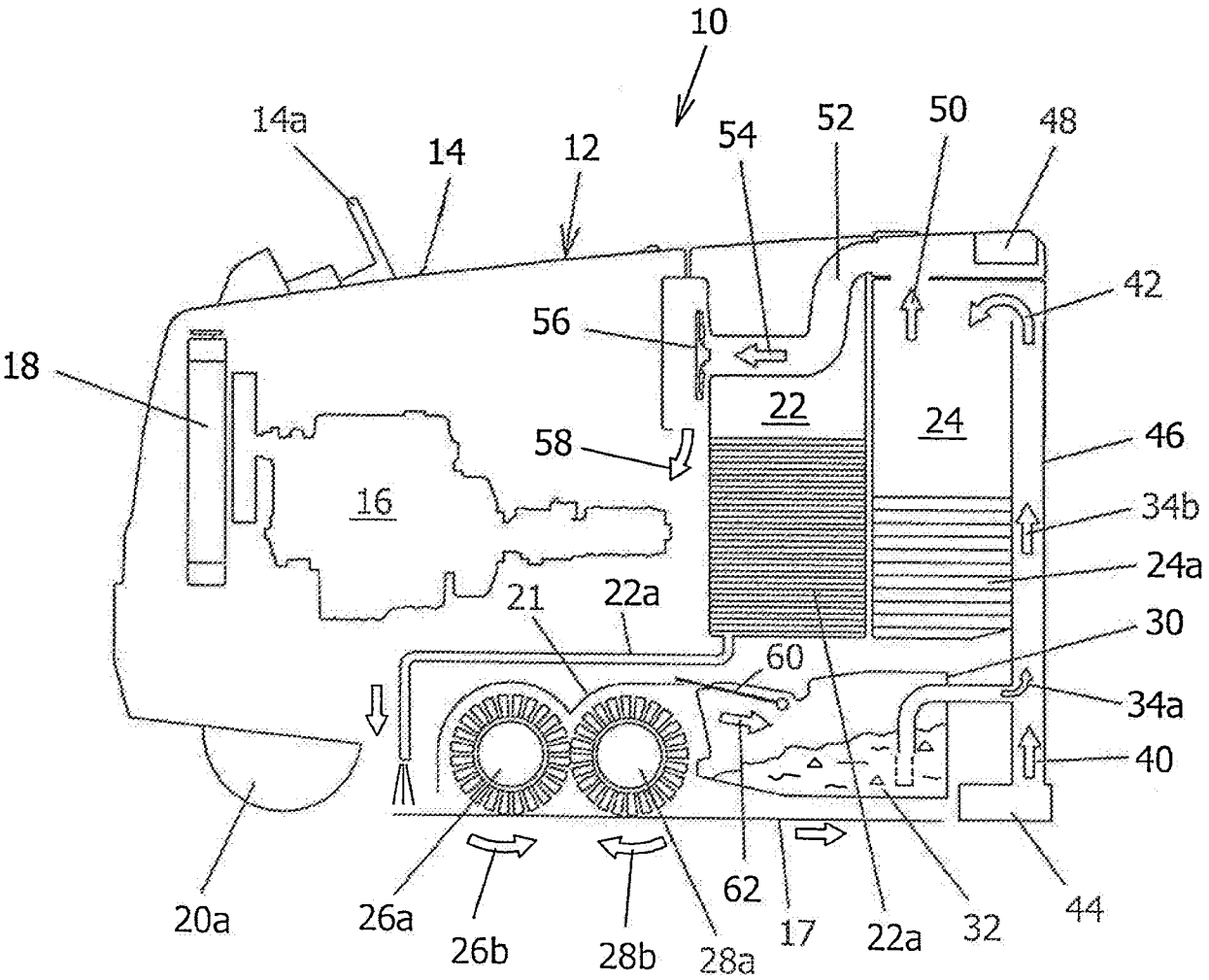
FIG. 1 is a simplified longitudinal sectional view of a floor scrubber sweeper machine shown in the operating, floor cleaning configuration in accordance with the present invention.

With reference to FIGS. 1-7, the inventive floor scrubber sweeper machine 10 will now be described in detail. As shown in the simplified longitudinal sectional views of FIGS. 1 and 2, scrubber sweeper machine 10 includes a chassis 12 having an operator compartment 14 which includes, among other things, a steering wheel 14*a*. Also disposed within chassis 12 is the combination of an engine 16 for propulsion and a radiator 18 for controlling the operating temperature of the engine. Disposed within chassis 12 is also a clean solution tank 22 containing a cleaning solution 23 which is deposited via a cleaning solution discharge conduit 22*a* on the floor 17 being cleaned forward of the combination of forward and aft cylindrical scrub brushes 26*a*, 28*a*. The forward and aft cylindrical scrub brushes 26*a*, 28*a* are rotationally displaced in opposing directions as shown by direction arrows 26*b* and 28*b*. The counter-rotation of the forward and aft cylindrical scrub brushes 26*a* and 28*a* causes debris, including dirty water on the surface of the floor, to be projected upwardly between the two rotating scrub brushes and rearwardly by the forward movement of the scrubber sweeper machine 10 and the contour of its undercarriage 21. The debris displaced by the forward and aft cylindrical scrub brushes 26*a* and 26*b* is directed into the open forward portion of a debris hopper 30, which debris as shown as element 32 in FIG. 1. Hopper 30 includes a forward pivoting door 60.

The fluid, or water, 32 within hopper 30 is drawn upwardly in the direction of arrows 34*a* and 34*b*, as shown in FIG. 1, by means of the suction action of a vacuum fan 56 disposed in an upper portion of a machine's chassis 12. Also disposed in an aft portion of chassis 12 is the combination of a rear squeegee 44 and a squeegee vacuum hose 46 as also shown in FIG. 1, where the rear squeegee is shown disposed in contact with the surface of floor 17. The fluid collected by squeegee 44 is drawn up through the squeegee vacuum hose 46 and into a reclaimed dirty solution tank 24, where arrow 42 illustrates the flow of collected fluid from the squeegee vacuum hose and into the reclaimed dirty solution tank. A demister 48 disposed in an upper, aft portion of chassis 12 removes mist and vapor from the extracted air and directs it in the direction of arrow 54. The air thus drawn by vacuum fan 56 is discharged from the floor scrubber sweeper 10 and into the atmosphere as shown by flow direction arrow 58.

Figure 2:
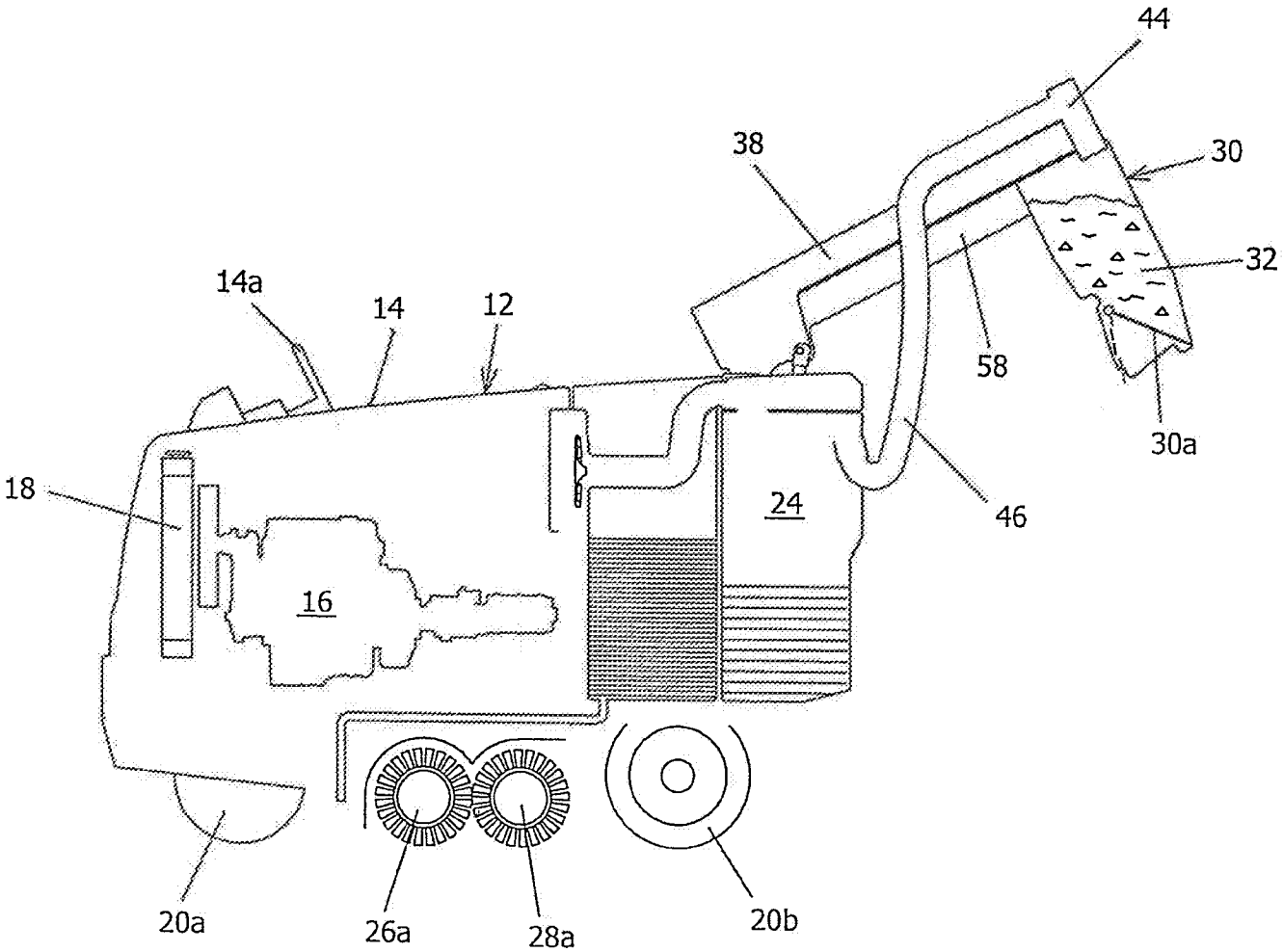
FIG. 2 is a simplified longitudinal sectional view of the present invention showing the debris hopper and squeegee in fully upraised positions.

With reference to FIG. 2, debris hopper 30 and squeegee 44 are shown in the full up position. The hopper's door 30*a* is shown in the closed position so as to retain the debris and fluid within the hopper 30. By moving the hopper door 30*a* to the position where it is shown in dotted line form, the fluid and debris is discharged from the hopper 30 under the influence of gravity. Also as shown in FIG. 2, squeegee lift arm 38 and hopper lift arm 58 are fully elevated to maintain the hopper 30 and squeegee 44 in their fully elevated positions. Also shown is the flexible squeegee vacuum hose 46 coupling squeegee 44 to the dirty solution tank 24 located in an aft portion of the scrubber sweeper's chassis 12.

Figure 3:
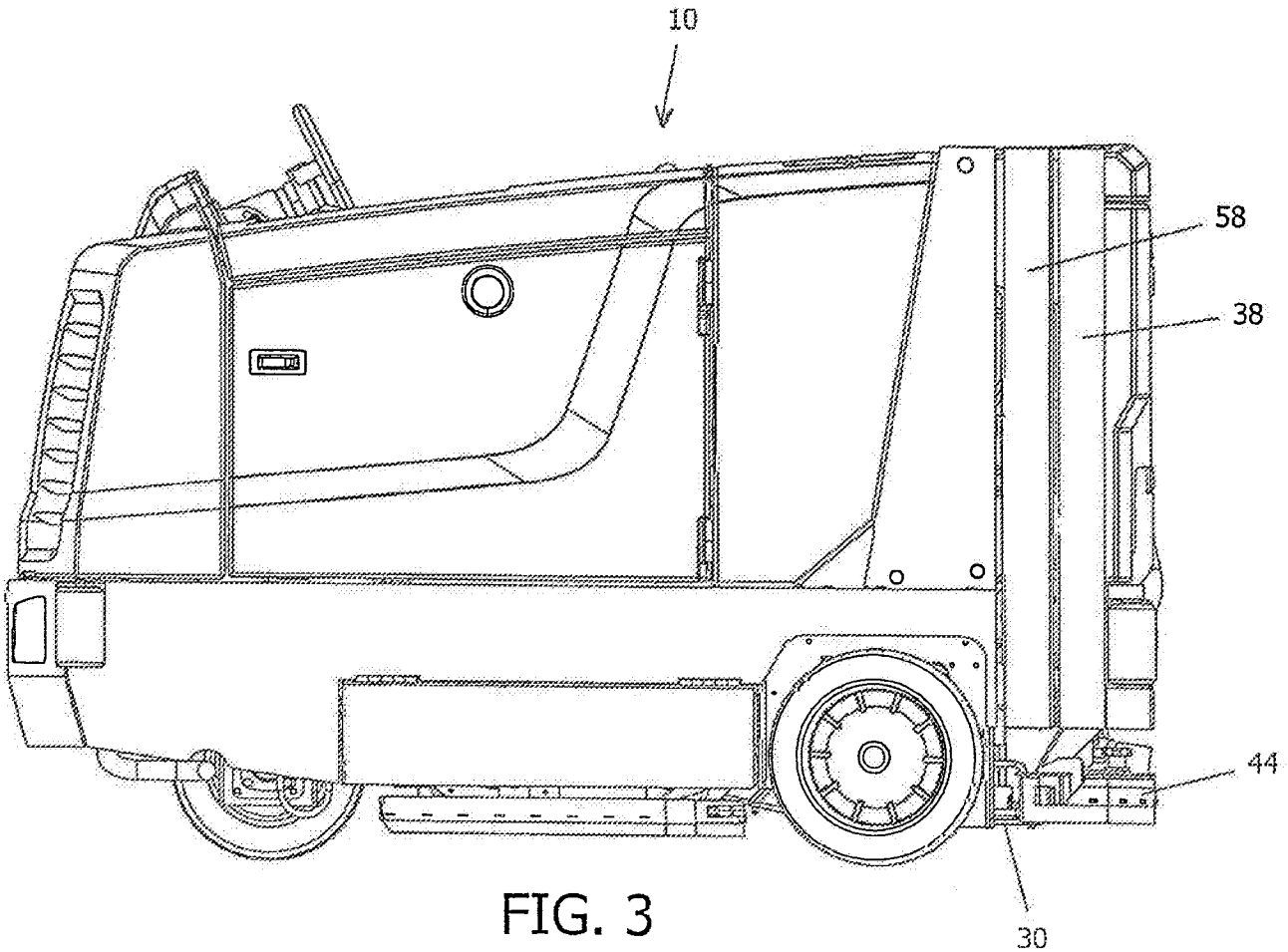
FIG. 3 is a lateral view of the inventive floor scrubber sweeper machine shown in the operating, floor cleaning configuration.
Figure 4:
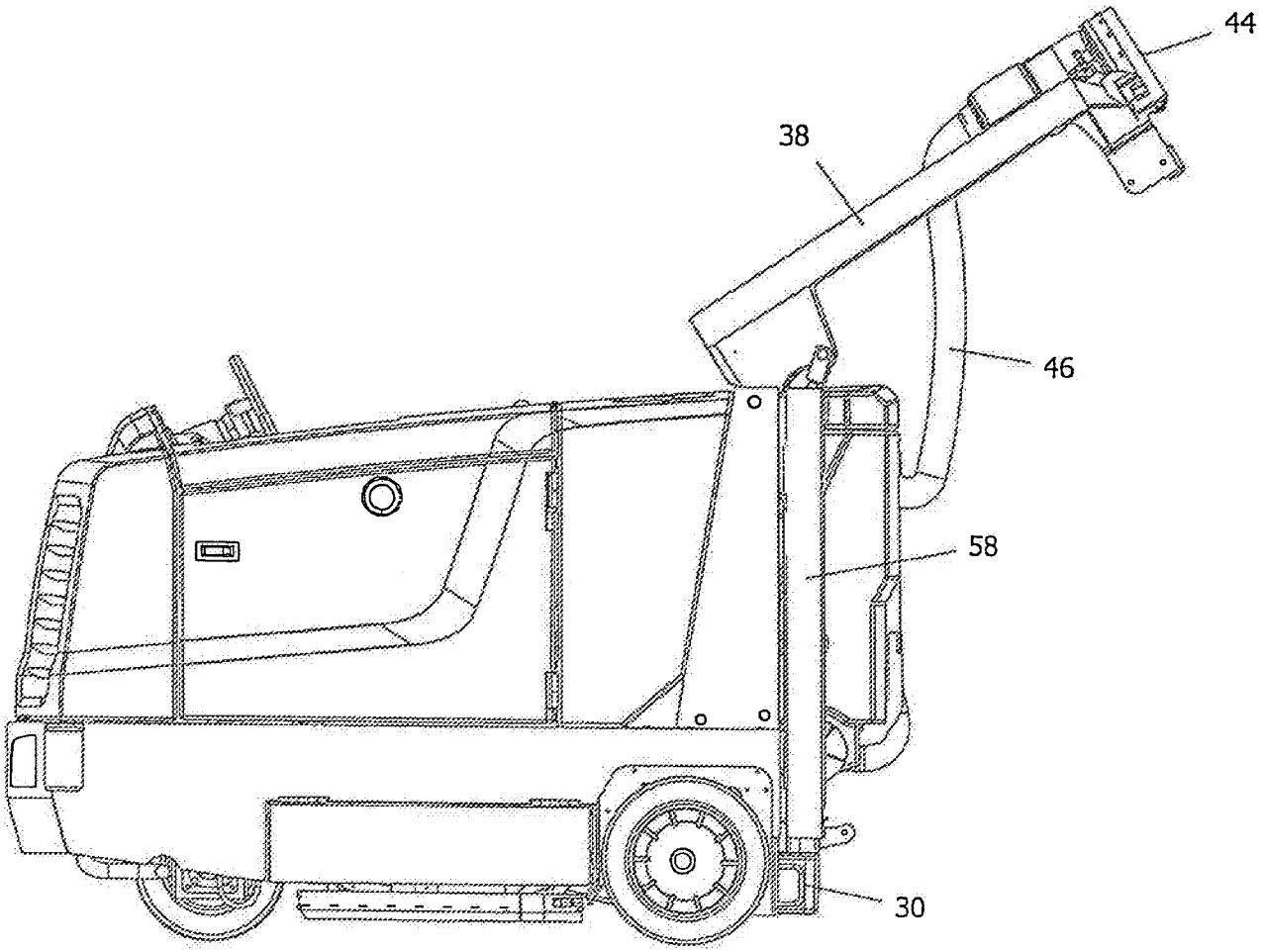
FIG. 4 is a lateral view of the inventive floor scrubber sweeper machine showing the squeegee in the fully upraised position and the hopper in the lowered, use position.
Figure 5:
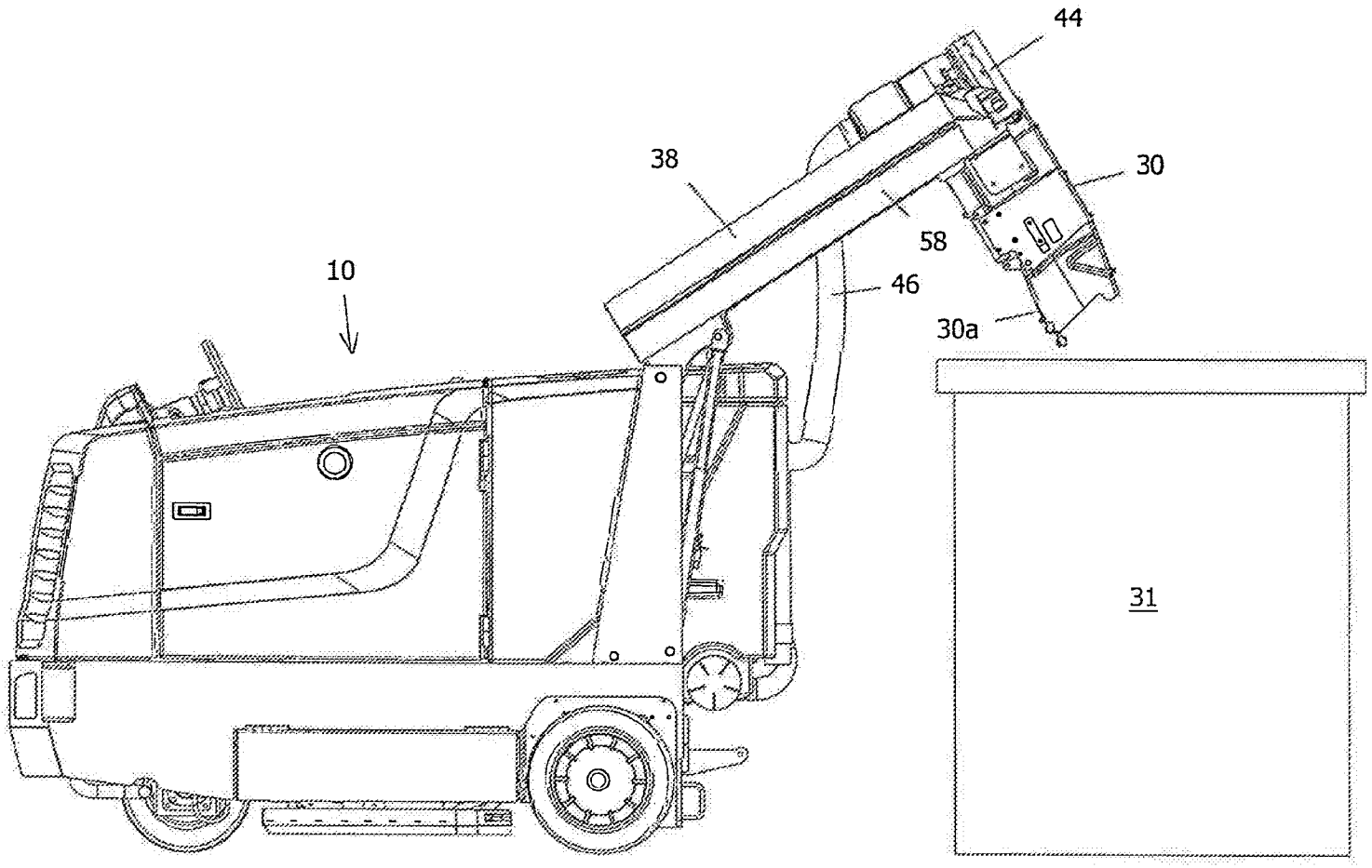
FIG. 5 is a lateral view of the inventive floor scrubber sweeper machine showing both the debris hopper and squeegee in fully upraised positions.
Figure 7:
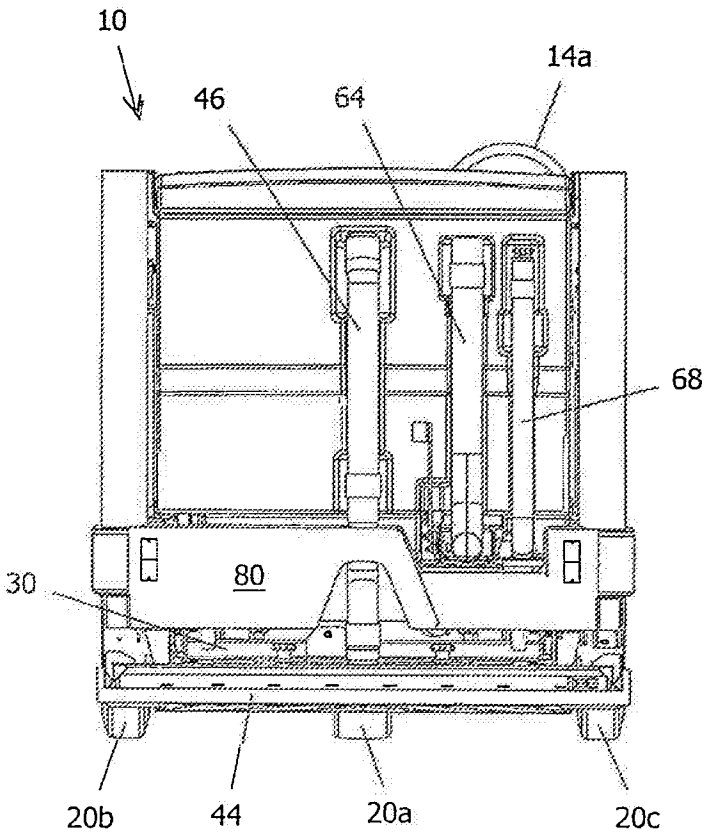
FIG. 7 is an aft plan view of the inventive floor scrubber sweeper machine showing the debris hopper in the full down, operating positions and the squeegee in raised, transparent position.
Figure 6:
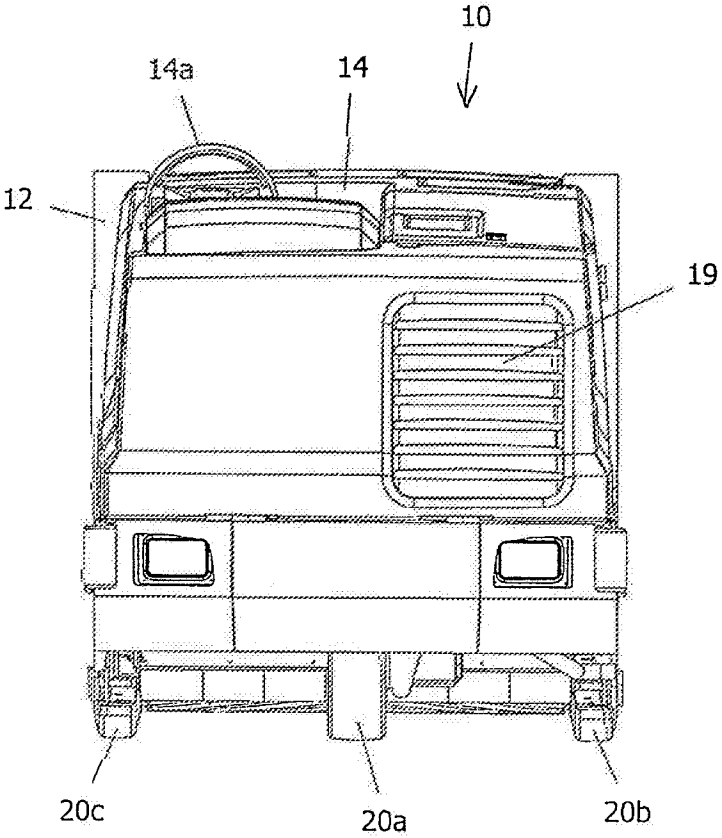
FIG. 6 is a front plan view of the inventive floor scrubber sweeper machine.
Figure 8:
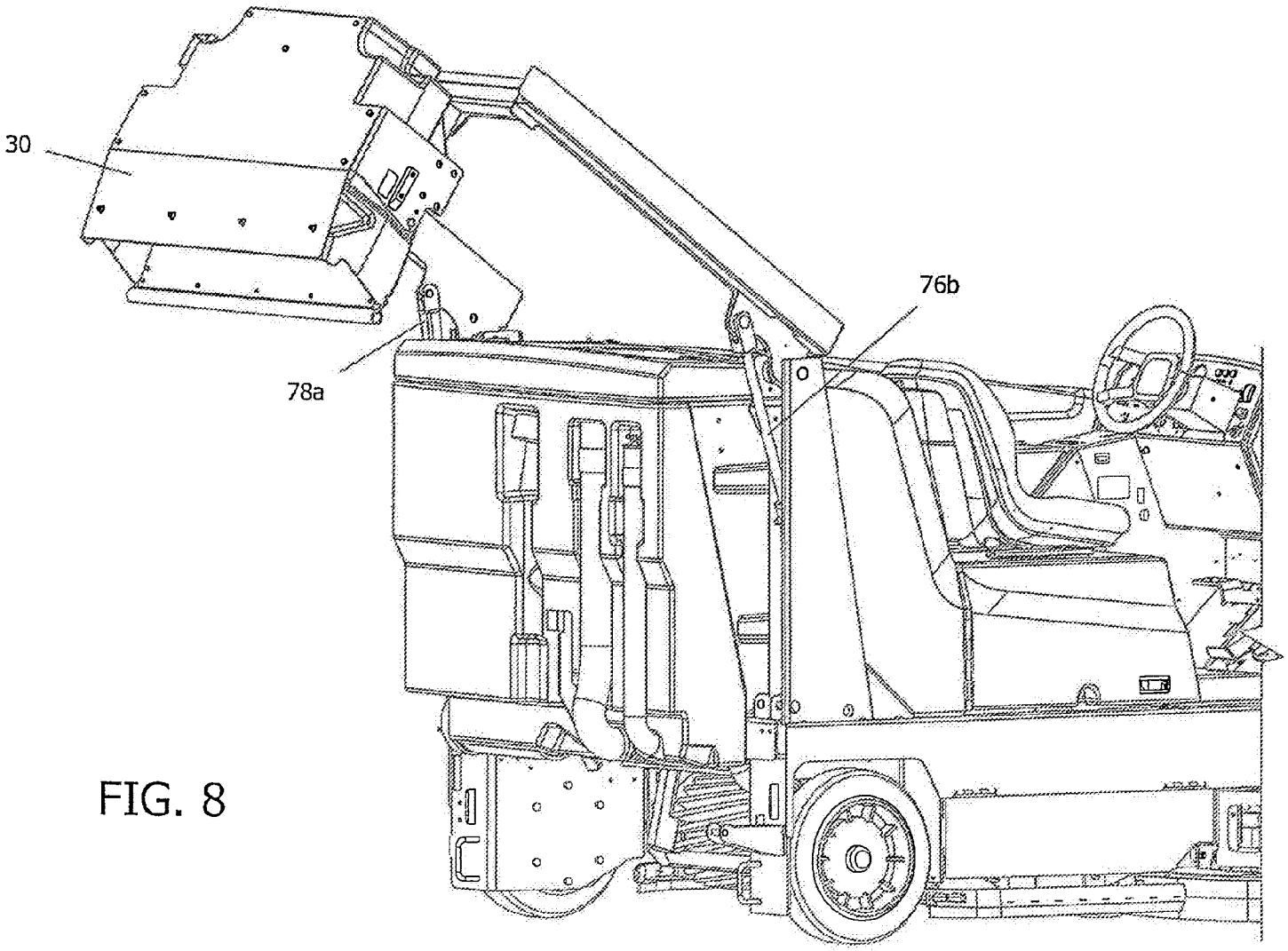
FIG. 8 is an aft right perspective view of the inventive floor scrubber sweeper machine with the squeegee removed for more clearly showing the debris hopper in the full up position.
Figure 9:
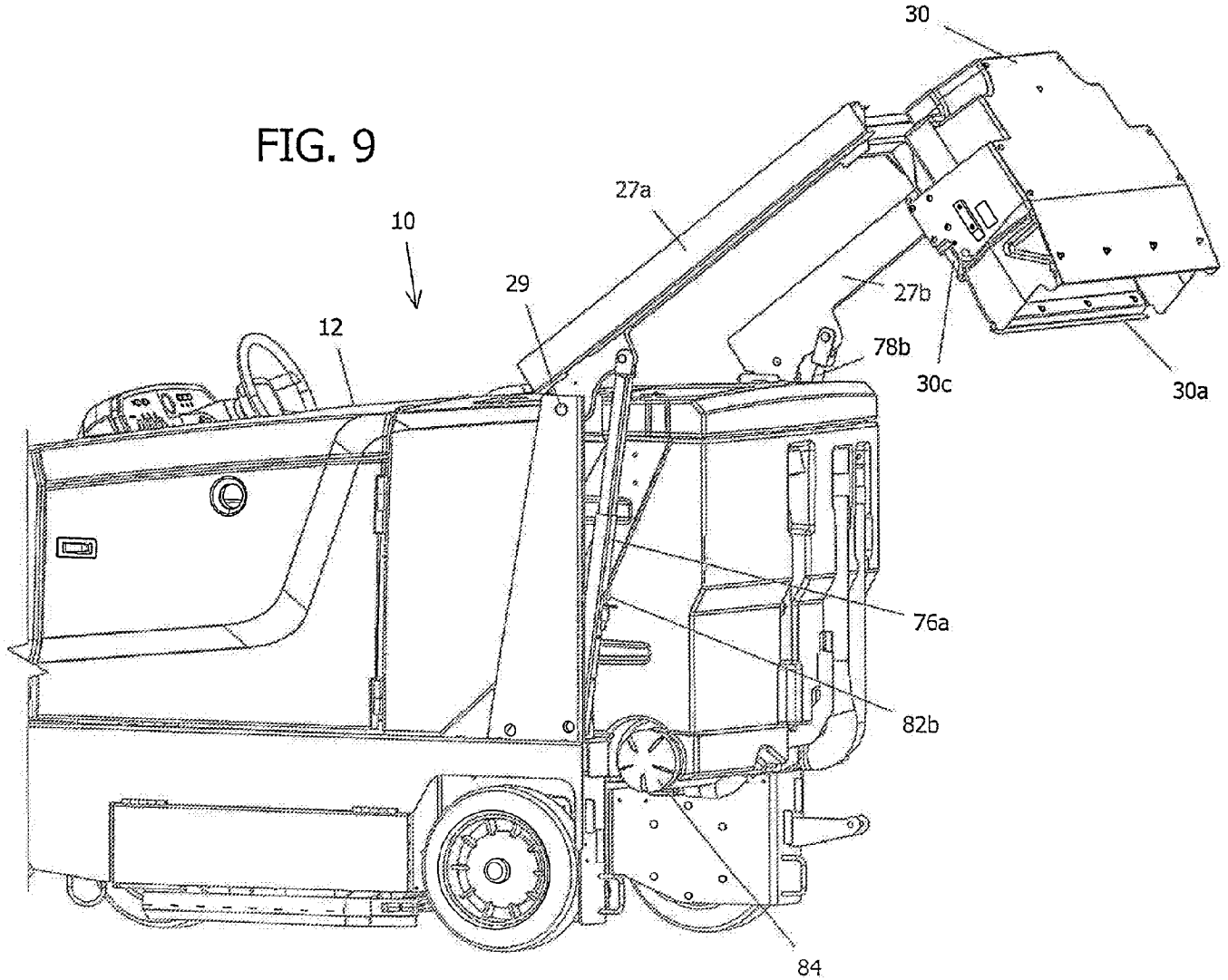
FIG. 9 is an aft left perspective view of the inventive floor scrubber sweeper machine with the squeegee removed for more clearly showing the debris hopper in the full up position.

FIG. 3 is a side elevation view of the floor scrubber sweeper machine 10 with its debris hopper 30 and its rear squeegee 44 shown in the full down, use position, and with the squeegee lift arm 38 and the debris hopper lift arm 58 aligned in closely spaced, parallel vertical alignment. FIG. 4 is a side elevation view of the inventive floor scrubber sweeper machine 10 showing only its rear squeegee 44 in the full up position, with its debris hopper 30 shown in the full down, operating position. FIG. 5 is also a side elevation view of the inventive floor scrubber sweeper machine 10 showing both debris hopper 30 and squeegee 44 in the full up position, with the hopper's door 30*a* in the open position to allow for the discharge of debris from the hopper into a high, typically 60", debris dumpster 31. FIG. 6 is a front plan view of the inventive floor scrubber machine 10 illustrating its three wheels 20*a*, 20*b* and 20*c*, as well as a radiator grill 19 disposed on a forward portion of the machine's chassis 12. The machine's front wheel 20*a* provides a steering capability and propulsion. FIG. 7 is an aft plan view of the inventive floor scrubber sweeper machine 10 with its debris hopper 30 and its rear squeegee 44 in an upraised position. Also shown in FIG. 7 is the squeegee vacuum hose 46, as well as a recovery, or reclaimed dirty solution, tank drain hose 64 coupled to the above described recovery tank 24. Also illustrated in FIG. 7 is a clean solution drain hose 68 coupled to the above-described clean solution tank 22 for allowing for draining clean solution from the clean solution tank.

Figure 10:
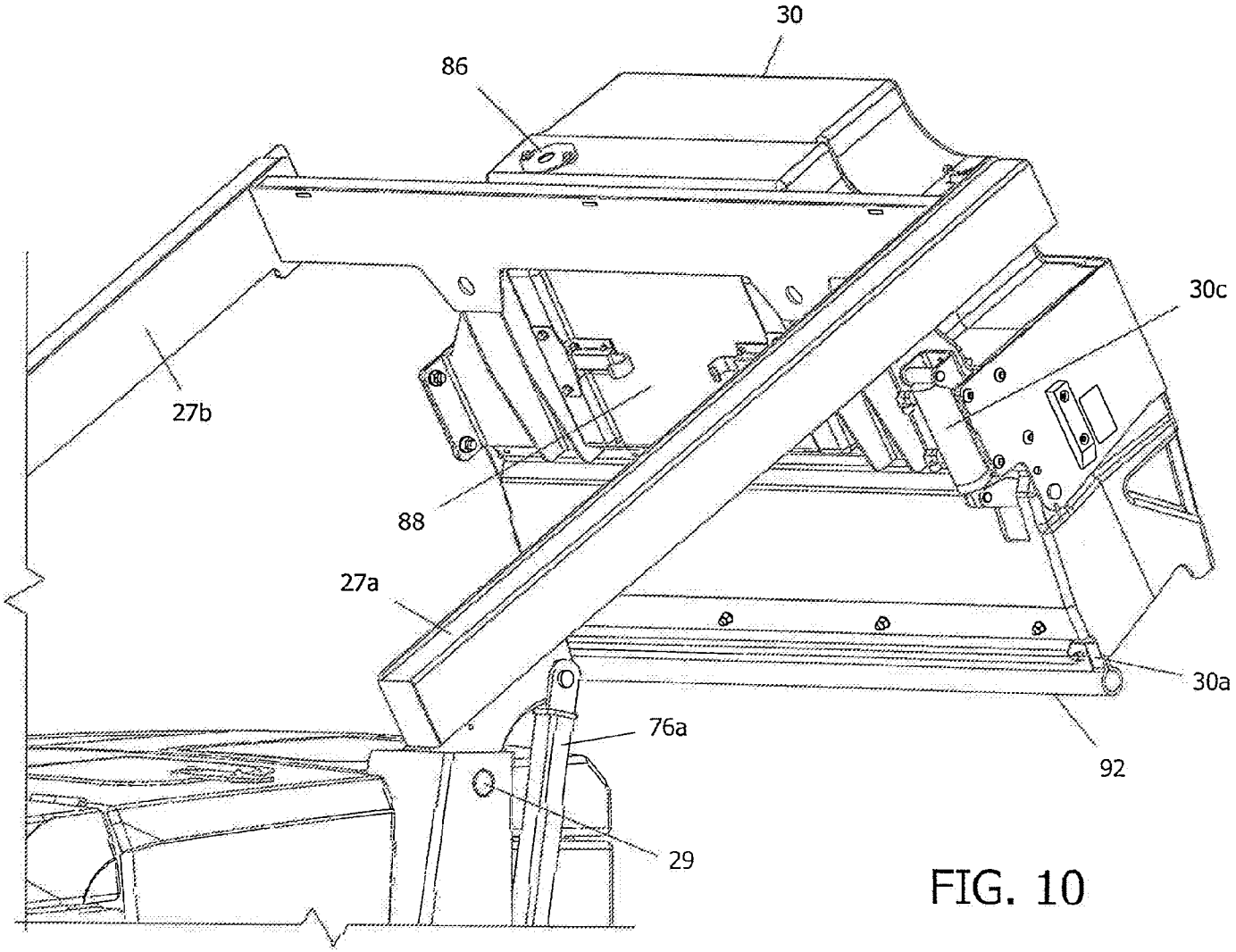
FIG. 10 is a perspective view of the debris hopper in the full up position.

Referring to FIGS. 8, 9, 10 and 11, there are shown various perspective views of the debris hopper 30 in the full up position. Attached to the debris hopper 30 are first and second support arms 27*a* and 27*b*. Respective first ends of each of the first and second support arms 27*a*, 27*b* are pivotally coupled to an aft, upper portion of chassis 12 by means of a respective pivot pin, where pivot pin 29 is shown in FIG. 10 pivotally coupling first support arm to an aft upper portion of the chassis. Second, opposed ends of each of the first and second support arms 27*a* and 27*b* are securely coupled to respective lateral portions of the debris hopper 30. Pivotally coupled to respective intermediate portions of each of the first and second support arms 27*a*, 27*b* is a respective telescoping tube or hydraulic cylinder as described below.

Figure 14:
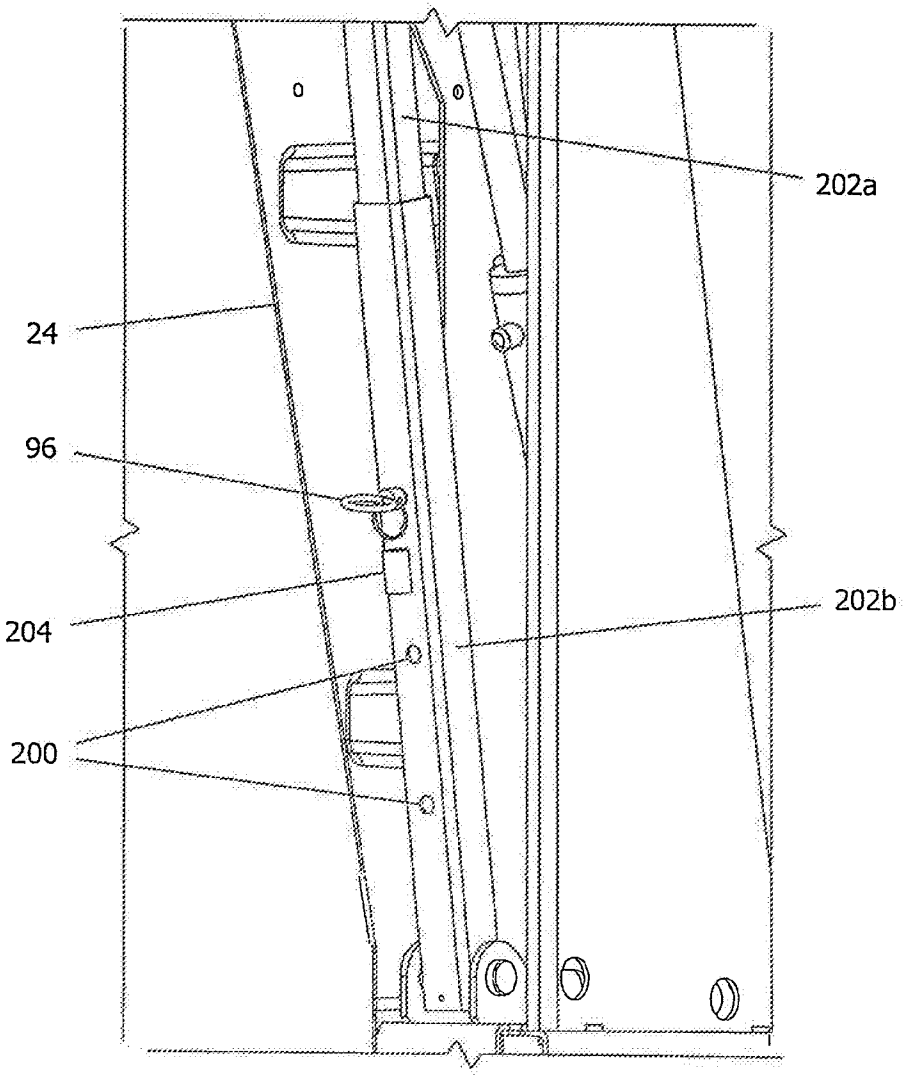
FIGS. 14 and 15 are perspective views of an arrangement for securely maintaining the debris hopper or the squeegee in a fixed upraised position.
Figure 15:
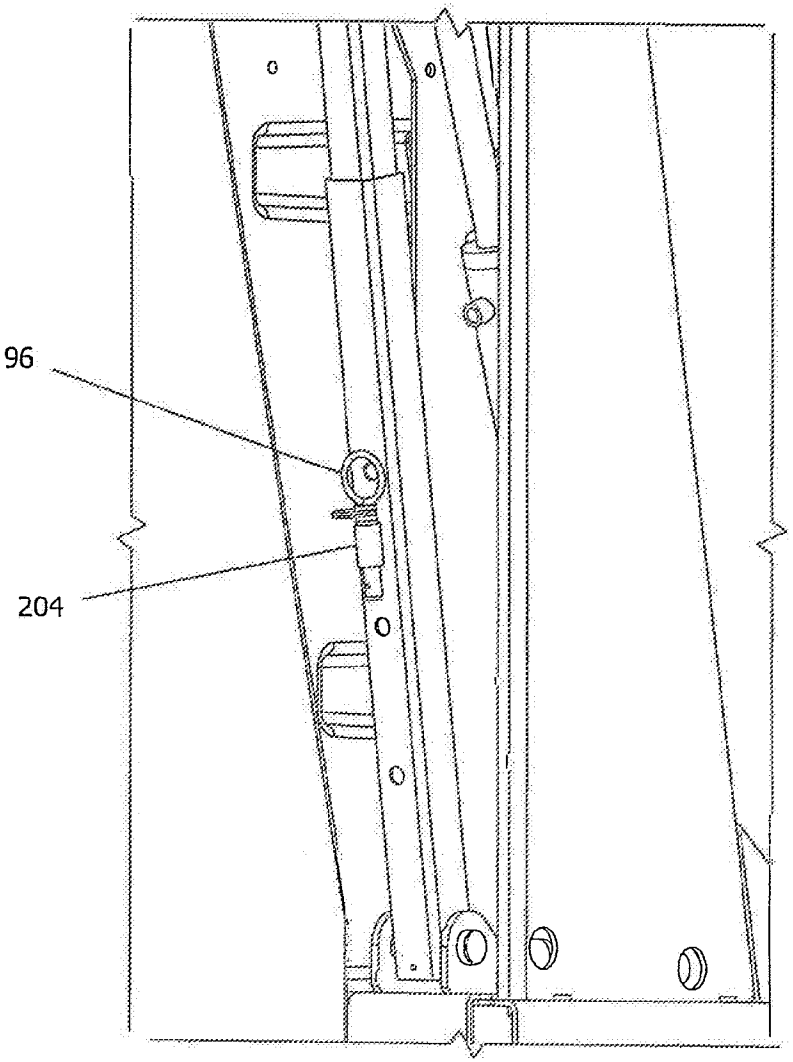

More specifically, respective intermediate portions of the squeegee's first and second support arms 58*a* and 58*b* are coupled to respective first ends of a first hydraulic cylinder 78*a* and to a first telescoping tube 78*b*. Similarly, respective intermediate portions of the debris hopper's first and second support arms 27*a* and 27*b* are coupled to a second telescoping tube 76*a* and to a second hydraulic cylinder 76*b*. The first hydraulic cylinder 78*a* raises and lowers squeegee 44, while second hydraulic cylinder 76*a* raises and lowers hopper 30. The second telescoping tube 76*a* provides support and alignment for the debris hopper 30, while the first telescoping tube 78*b* provides support and alignment for squeegee 44. As shown in FIGS. 14 and 15, the second telescoping tube 76*a* includes an upper, inner tube 202*a* and a lower, outer tube 202*b* coupled together in a sliding manner to allow the tube's length to change. Aligned apertures 200 are disposed in a spaced manner in the upper, inner and outer, lower tubes 202*a* and 202*b*, and are adapted to receive a safety pin 96 for maintaining the debris hopper 30 and/or the squeegee at an elevated position in a fixed manner. A support bracket 204 is attached to an outer portion of lower tube 202*b* and is adapted to receive safety pin 96 for storage as shown in FIG. 15.

As shown in FIG. 10, debris hopper 30 includes a hydraulic cylinder 30*c* for opening and closing the hopper's door 30*a*. Disposed on an aft portion of the debris hopper 30 is a hopper suction hose seal plate 86 which is adapted for sealed coupling to a suction hose attached to the recovery tank drain hose 64. Debris hopper 30 includes a lower removable clean out cover 88 for removing debris adhering to the inside of hopper 30. In addition, hopper door 30*a* is provided with a door seal 92 for preventing discharge of debris from the hopper when the door is closed. Provided at a lower, lateral portion of chassis 12 is a clean out cap 84 for removing residual debris from the recovery tank 24.

Figure 11:
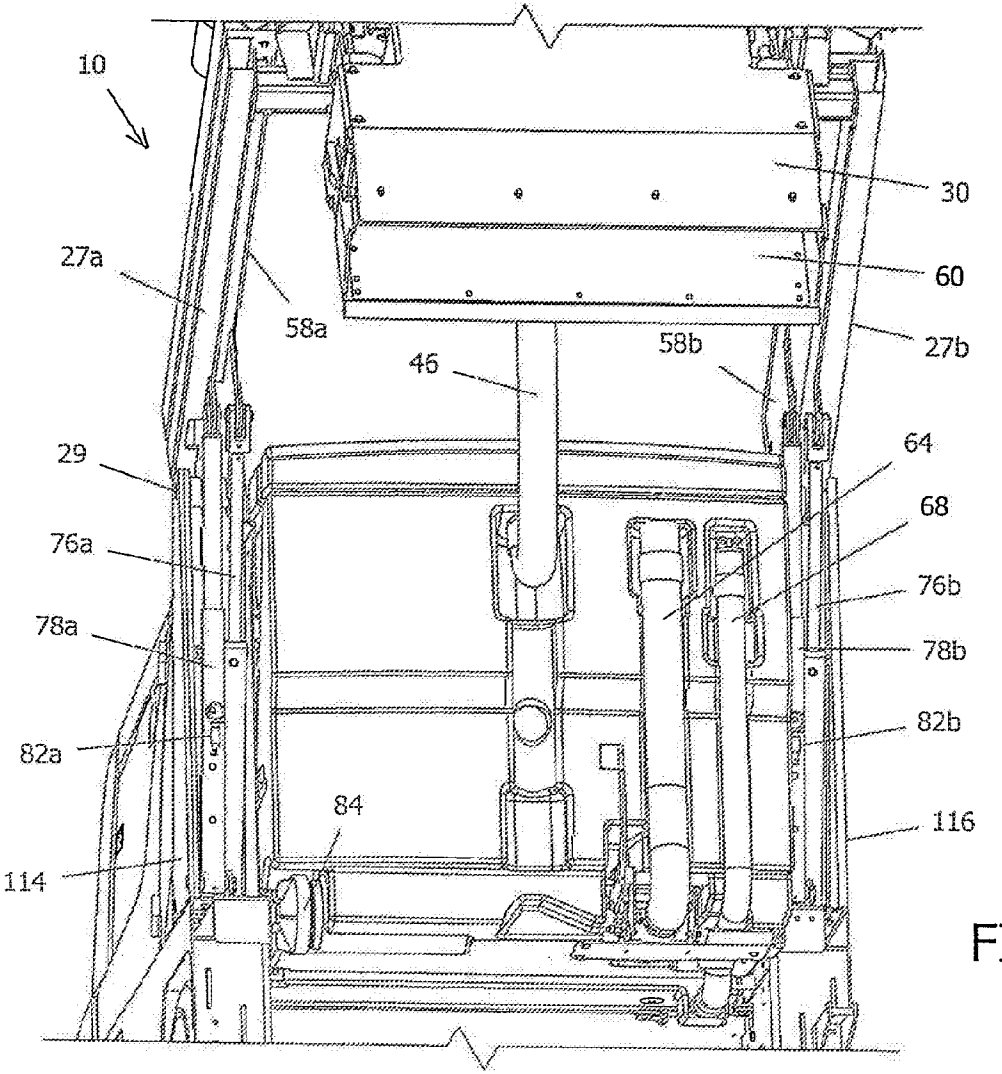
FIG. 11 is an aft perspective view of the debris hopper with the debris hopper in the full up position.

FIG. 11 is an aft perspective view of the inventive floor scrubber sweeper machine 10 with its hopper 30 as well as its rear squeegee (not shown in the figure for simplicity) in the full up position. As described above, hopper 30 is supported and displaced by means of the combination of the second telescoping tube 76*a* and second hydraulic cylinder 76*b* and first and second support arms 27*a* and 27*b*. Similarly, squeegee 44 is supported and displaced by means of third and fourth support arms 58*a* and 58*b* in combination with first hydraulic cylinder 78*a* and first telescoping tube 78*b*. The pair of squeegee support arms 58*a*, 58*b* are disposed inside of the pair of hopper support arms 27*a* and 27*b*. Extension of the second hydraulic cylinder 76*b* raises support arms 27*a* and 27*b* as well as debris hopper 30, while retraction of this hydraulic cylinder lowers the combination of the first and second support arms and also lowers the hopper. Similarly, extension and retraction of second hydraulic cylinder 78*a* raises and lowers the combination of third and fourth support arms 58*a* and 58*b*, as well as squeegee 44.

Figure 12:
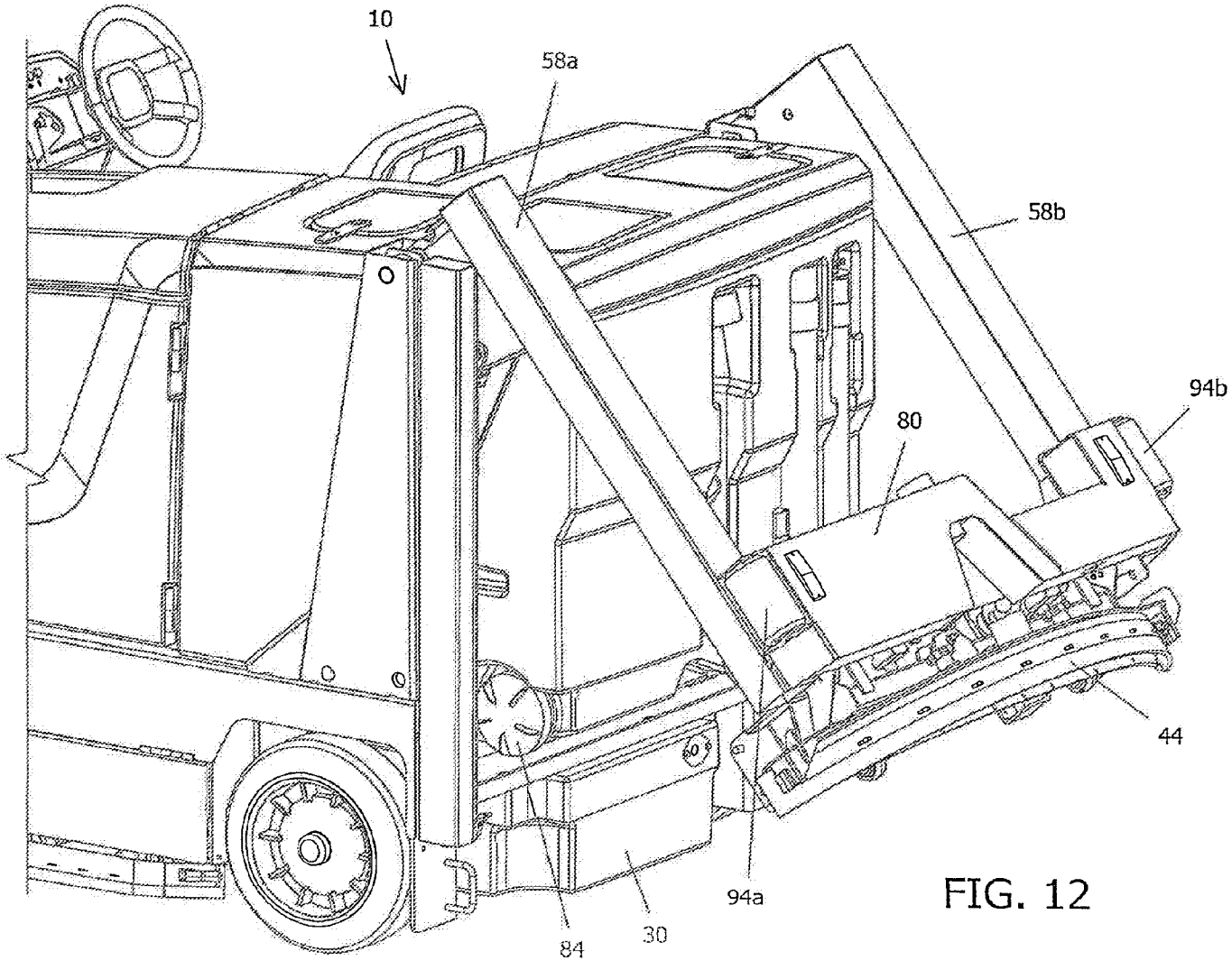
FIG. 12 is a perspective view of the squeegee shown in a partially upraised position such as for inspecting, adjusting, maintaining or replacing the squeegee.

Referring to FIG. 12, there is shown a perspective view of squeegee 44 in an intermediate elevated position to facilitate inspection, adjustment, maintenance or replacement of the squeegee. First and second rollers 94*a* and 94*b* are attached to and disposed adjacent respective opposed ends of bumper 80. These rollers 94*a* and 94*b* are adapted for engaging and facilitating displacement along walls during operation of the floor scrubber sweeper machine 10. The squeegee's vacuum hose 46 has been omitted from FIG. 12 for the purpose of clarity. As shown in FIG. 12, squeegee 44 is concave in the direction of travel of the floor scrubber sweeper machine 10 during operation.

Figure 13:
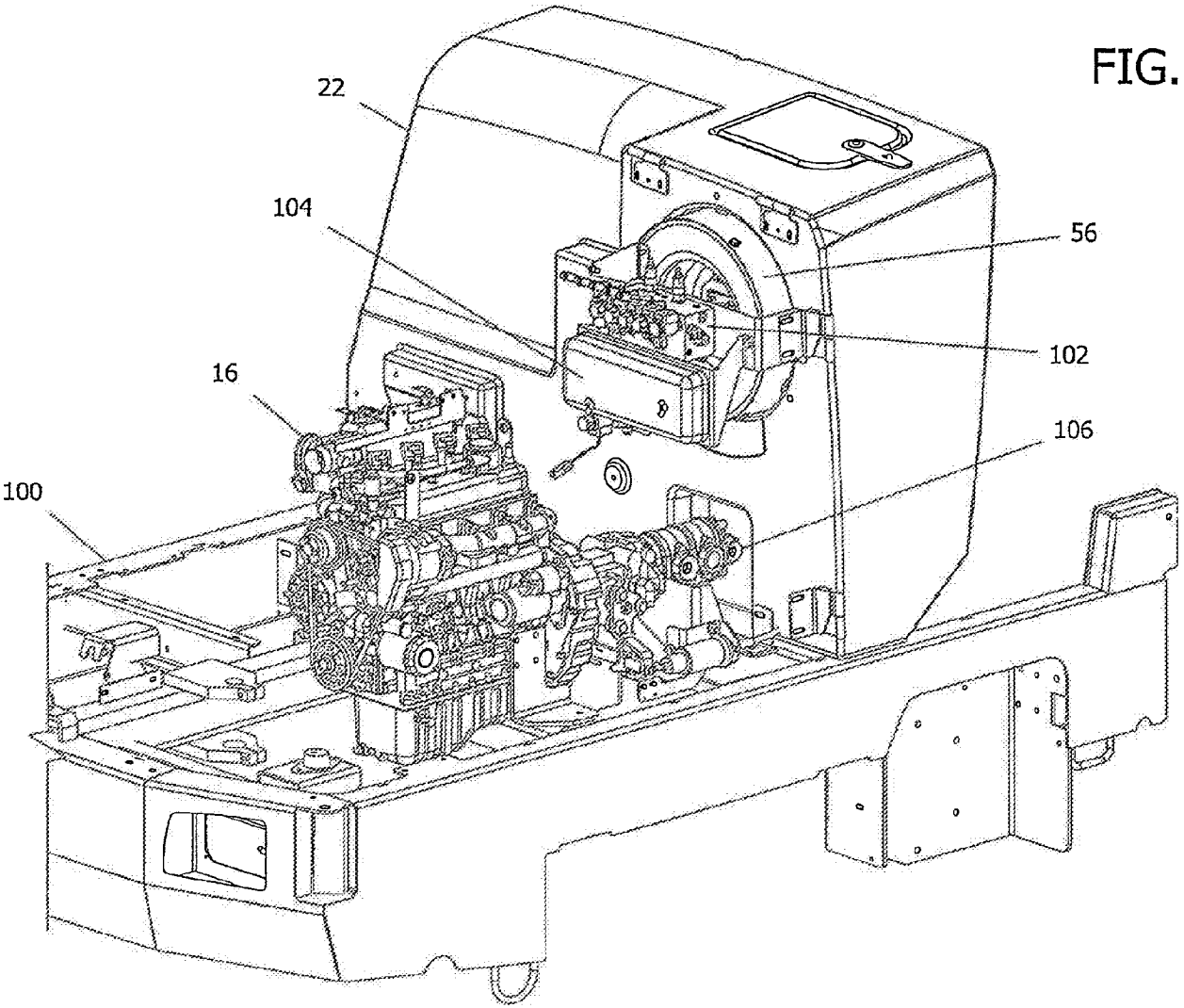
FIG. 13 is a simplified perspective view illustrating the floor scrubber sweeper machine's frame, engine, high dump hydraulic manifold and high dump electrical system in one embodiment of this invention.

Referring to FIG. 13, there is shown a perspective view of the scrubber sweeper machine's frame 100, clean solution tank 22, vacuum fan, or impeller, 56, as well as its engine 16. Also shown in FIG. 13 is its high dump hydraulic manifold 102, its high dump electrical components 104 and hydraulic pumps 106. The operation of these various components is described in detail in the following paragraphs.

Figure 16:
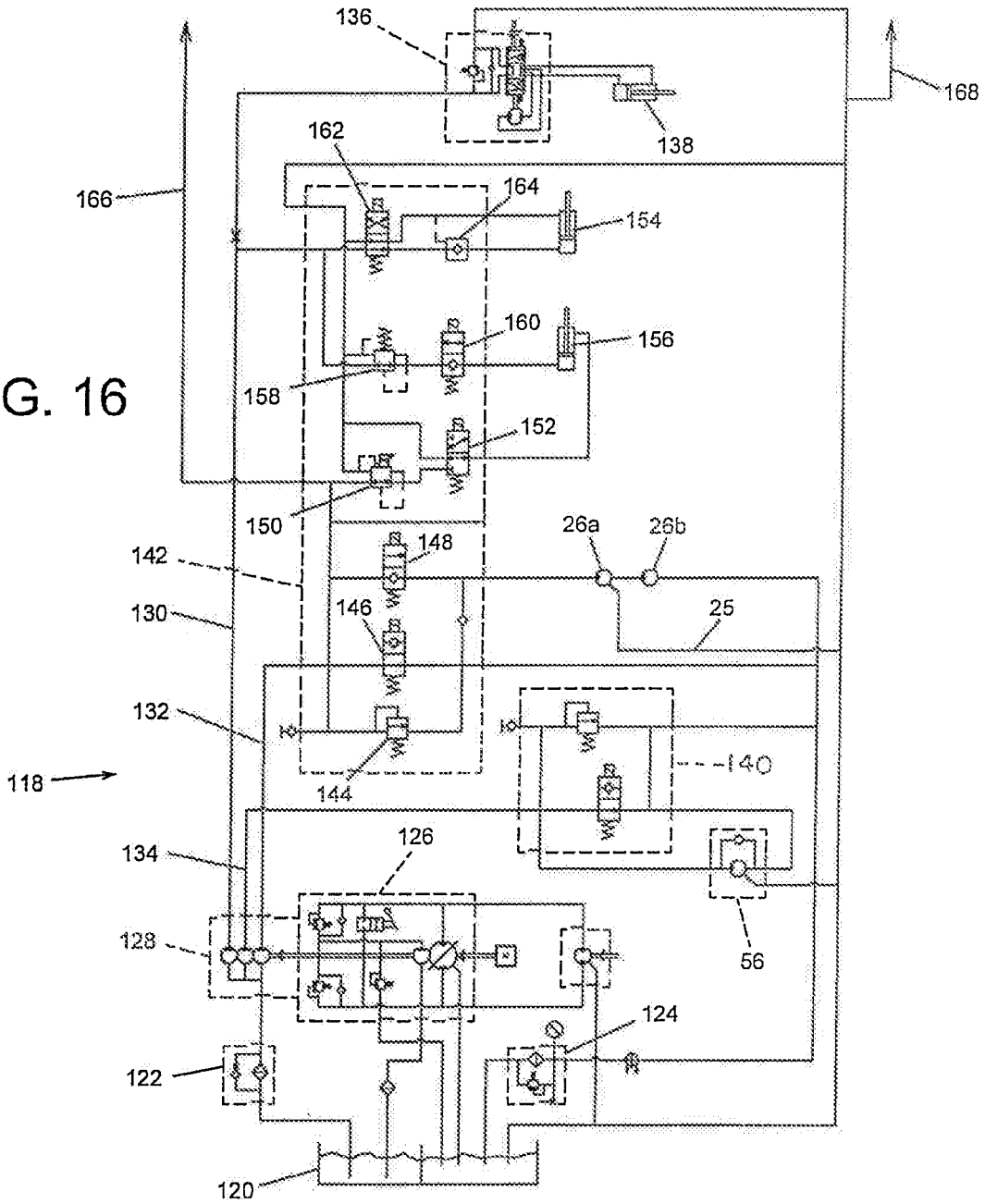
FIGS. 16 and 17 are schematic diagrams of a hydraulic system for raising and lowering the scrubber sweeper's debris hopper and squeegee in accordance with one embodiment of the present invention.
Figure 17:
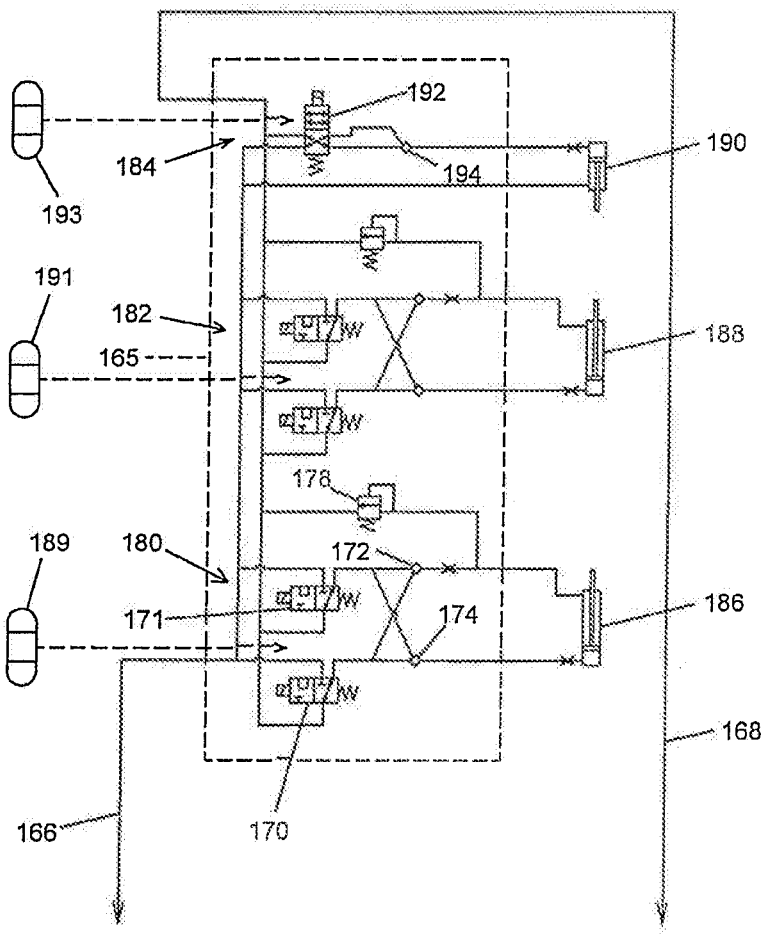

Referring to FIGS. 16 and 17, there is shown a hydraulic system 118 for use in the disclosed embodiment of the present invention. Hydraulic system 118 includes a hydraulic fluid reservoir 120 coupled to a propulsion pump 126. Propulsion pump 126 provides propulsion for the inventive scrubber sweeper machine 10 and is coupled to an auxiliary pump 128 which includes three individual pumps. A first pump is coupled via a first hydraulic line 130 to a vehicle steering unit 136 which, in turn, is coupled to a steering cylinder 138. The output of the steering unit 136 is provided to the steering cylinder 138 which controls the position of the vehicle's front wheel 20*a* in response to operator inputs. Hydraulic reservoir 120 is further coupled to auxiliary pump 128 via a hydraulic fluid strainer 122. A second output from a second pump within auxiliary pump 128 is provided via a second hydraulic line 134 to a vacuum fan manifold 140 for controlling the operation of the previously described vacuum fan 56 which is connected to the high dump hydraulic manifold 102.

A third output from the auxiliary pump 128 from a third pump therein is provided via a third hydraulic line 134 to a main manifold 142. This output from the auxiliary pump 128 is more specifically provided to an ALL OFF solenoid valve 146. Main manifold 142 further includes a MAIN BRUSHES ON-OFF solenoid valve 148 which operates in conjunction with the ALL OFF solenoid valve 146 to control the operation of the forward and aft cylindrical scrub brushes 26*a*, 26*b*. With the ALL OFF solenoid valve 146 off, this valve transmits hydraulic fluid. Fluid to the scrub brushes 26*a* and 28*a* is blocked and returned to the hydraulic reservoir 120 via hydraulic line 25. With both of the ALL OFF and MAIN BRUSHES ON-OFF solenoid valves 146, 148 energized, the ALL OFF solenoid valve blocks the flow through return path 25 and the MAIN BRUSHES ON-OFF solenoid valve allows the fluid to go to the brushes. Main manifold 142 further includes a BRUSH FORCE solenoid valve 150 and a MAIN BRUSHES DOWN solenoid valve 152 for controlling the downward pressure to be applied by the forward and aft cylindrical scrub brushes 26*a*, 28*a* to the floor being cleaned. Control of the operation of the combination of BRUSH FORCE solenoid valve 150 and MAIN BRUSHES DOWN solenoid valve 152 is provided by means of an operator controlled free position rotary switch which is not shown in the figure for simplicity. If the operator selects a downward pressure of 865 pounds per square inch (psi), the pressure applied to the upper portion of a squeegee cylinder 154 works in conjunction with the 450 psi applied to the bottom of the squeegee cylinder via the combination of a squeegee up-down solenoid valve 162 and a control valve 164 so that a maximum downward pressure is exerted by the forward and aft scrub brushes 26*a*, 28*a* on the floor being cleaned. Similarly, selection of an intermediate downward pressure or a minimum downward pressure by means of the BRUSH FORCE 100-800 psi solenoid valve 150 results in either in intermediate or a minimum downward pressure being exerted by the scrub brushes on the floor via a brush lift cylinder 156. In summary, the amount of pressure applied via the BRUSH FORCE 100-800 psi solenoid valve 150 and the MAIN BRUSHES DOWN solenoid valve 152 to the upper portion of the BRUSH LIFT CYLINDER 156 controls and determines the amount of downward pressure applied by the brushes to the floor, which downward force works in conjunction with the upward force applied to the lower portion of the BRUSH LIFT CYLINDER via the combination of the reduction valve 158 and MAIN BRUSHES UP-LOCK solenoid valve 160. In addition, the MAIN BRUSHES UP-LOCK solenoid valve 160 performs the function of maintaining the elevation of the brush when in the non-use position following shut down of the scrubber sweeper machine 10. If the MAIN BRUSHES DOWN solenoid valve 152 is off, the output of the MAIN BRUSHES UP-LOCK solenoid valve 160 to the lower portion of the BRUSH LIFT CYLINDER 156 automatically raises the elevation of the forward and aft scrub brushes 26*a*, 28*a* to on the order of six inches above the floor engaging position during operation. Main manifold 142 further includes a SQUEEGEE UP-DOWN solenoid valve 162 in combination with a check valve solenoid 164 which are coupled to squeegee cylinder 154 for controlling an intermediate height of the squeegee 44 above the floor. SQUEEGEE UP-DOWN solenoid valve 162 is controlled by electrical inputs from the machine operator to operate in a first mode wherein hydraulic fluid is provided via the solenoid valve to an upper end of the squeegee cylinder 154 for urging the squeegee to the lower, use position wherein the squeegee engages the floor. Alternatively, the operator may select a second input to the SQUEEGEE UP-DOWN solenoid valve 162 so as to provide hydraulic fluid via a check valve 164 to a lower portion of the squeegee cylinder 154 for urging the squeegee to a higher, non-floor engaging position when the squeegee is not in use such as when the floor scrubber machine is in transport. As shown in FIG. 16, there is one output from the hydraulic system 118 in the form of a power output, or power beyond (PB), via line 166 and one input in the form of "B" via line 168.

Referring specifically to FIG. 17, there is shown an additional portion of the hydraulic system 118 shown in FIG. 14. The portion of the hydraulic schematic shown in FIG. 1 is hydraulically coupled to the hydraulic system 118 of FIG. 16 in that it receives power beyond an output B to the B input of the hydraulic system 118 shown in FIG. 16. The hydraulic system in FIG. 17 includes a secondary manifold 165 coupled to a squeegee lift arm hydraulic cylinder 186, a hopper lift hydraulic cylinder 188 and a hopper door hydraulic cylinder 190. Secondary manifold 165 includes first, second and third hydraulic switches 180, 182 and 184. The first and second hydraulic switches 180, 182 are respectively coupled to the squeegee lift arm hydraulic cylinder 186 and to the hopper lift hydraulic cylinder 188. The first and second switches 180, 182 are identical in configuration and operation. Therefore, only the operation of the first switch 180 is described in detail herein, it being understood that the second switch 182 operates in the same way to achieve the same end results with regard to the operation of the hopper lift hydraulic cylinder 188.

The first switch 180 includes a squeegee lift arm raise solenoid valve 170 and a squeeze lift arm lower solenoid valve 171. When a squeegee lift arm control button 189 is selected, the appropriate input is provided to solenoid valve 170 so that hydraulic fluid passes through check valve 174 to a lower portion of the squeegee lift arm hydraulic cylinder 186 as shown in FIG. 17, so as to cause the squeegee lift arm hydraulic cylinder to raise the squeegee's support arms 58*a*, 58*b*. Upward movement of the squeegee 44 and its associated support arms 58*a*, 58*b* is stopped at the specified, or desired, height, or elevation, by closing check valve 174. Squeegee 44 remains at that designated height until additional hydraulic fluid is provided to the squeegee lift arm hydraulic cylinder 186. The hydraulic fluid orifice port controls discharge of hydraulic fluid from the squeegee lift arm hydraulic cylinder 186 so as to allow the squeegee to descend slowly such as in the event of breakage or leakage of a hydraulic fluid line. The squeegee 44 is lowered by pressing a lower position control button selector 189 to allow hydraulic fluid to pass via upper check valve 172 to an upper portion of the squeegee lift arm hydraulic cylinder 186, while at the same time lower check valve 174 prevents the flow of hydraulic fluid from the lower portion of the squeegee lift arm hydraulic cylinder 186 to allow for lowering of squeegee 44. Thus, when hydraulic fluid is applied only to check valve 172 or only to check valve 174, the other check valve is opened allowing the change in the direction of motion of the squeegee 44. Each of the first and second check valves 172, 174 locks the squeegee lift arm hydraulic cylinder 186 in a fixed position until a new input is provided via the first switch 180 to the squeegee lift arm hydraulic cylinder 186. As indicated above, second switch 182 performs the same function in the same manner with respect to the hopper lift hydraulic cylinder 188 as the first switch 180 does to the squeegee lift arm hydraulic cylinder 186. As first switch 180 is coupled to the first control button 189, second switch 182 and third switch 184 are respectively coupled to second and third control buttons 191 and 193.

The third switch 184 includes a hopper door open-close hydraulic switch valve 192 for controlling the opening and closing of the door 30*a* of the debris hopper 30. Thus, an input to the hopper door open-close solenoid valve 192 is provided via line PB from the hydraulic system 118 shown in FIG. 16. With the hopper door open-close solenoid valve 192 turned off, and with the hydraulic system pressurized, pressure is applied to both sides of the hopper door hydraulic cylinder 190 which closes the debris hopper's door 30*a*. Just before the hopper 30 is raised, there is a timer (not shown) which times out to allow hydraulic pressure to be applied via the hopper door open-close solenoid valve 192 to the rod end, or lower end as shown in FIG. 17, of the hopper door hydraulic cylinder 190 so that it opens the debris hopper's door 30*a*. There is no switch for opening the debris hopper door 38, just for closing the door which is spring loaded to the OFF position. Thus, the debris hopper's door 38 is always open as the floor scrubber sweeper machine 10 is operating. Check valve 194 prevents opening of the debris hopper's door 38 when in a closed position.

In summary, each of the two lift arm assemblies is comprised of a respective pair of spaced support arms and has its own raise/lower hydraulic cylinder and telescoping tube which serves as a safety tube. The hydraulic cylinders 76*b* and 78*a* are used not only to raise the squeegee 44 and debris hopper 30, but also to lower the squeegee and debris hopper. Because the squeegee 44 and debris hopper 30 centers of gravity, when lowered, are forward of the lift arm pivot point, the squeegee and hopper do not fully retract due to gravity alone so that the pair of aforementioned hydraulic cylinders are used to fully retract the squeegee and hopper. As described above, each of the telescoping tubes 76*a* and 78*b* include a respective safety pin 96 that can be inserted at three different lift arm heights, i.e., a low position, a medium height position, and a fully upraised position. Also as described above, the hydraulic cylinder 78*a* that powers the squeegee support arm assembly is located on the left side of the floor scrubber sweeper machine 10, while its' associated telescoping tube 78*b* is located on the right side of the machine. Similarly, the hydraulic cylinder 76*b*, which powers the hopper support arm assembly, is located on the right side of the floor scrubber sweeper machine 10, while its' associated telescoping tube 76*a* is located on the left side of the machine. Squeegee 44, as described above, can be raised separately from the debris hopper 30, which is particularly useful when inspecting or performing maintenance on the squeegee. If desired, both of the squeegee and hopper support arm assemblies can be raised and lowered at the same time. The outer hopper support arm assembly is provided with a solenoid-operated latch 116, located at the lower end of the right lift arm 76*b* as shown in FIG. 11. This latch 116 ensures that the lift arms stay in place while the machine is moving as during scrubbing operations. The squeegee lift arm assembly is also provided with a tilt switch 114 located on the lower end of the left lift arm 78*a*. If the operator raises and then lowers the debris hopper 30 without opening its dump door 30*a*, tilt switch 114 will open the hopper dump door automatically when the hopper is within 15° of the fully lowered position such as shown in FIG. 1. An "interference" switch is located on the lower end of the inner (hopper) lift arms which prevents the hopper lift arms from contacting the squeegee lift arms when the squeegee lift arms are not fully raised.

Referring again to FIG. 17, there are shown a lift bumper/squeegee neutral switch 180, a center hopper control switch 182, and a right hopper dump door switch 184. The left bumper/squeegee switch 180 includes a squeegee lift arm raise valve 170 and a squeegee lift arm lower solenoid valve 170 in combination with first and second check valves 172 and 174 for controlling the squeegee lift arm cylinder 186. Center switch 182 operates in the same way and includes the same components to control the raising and lowering of the hopper lift cylinder 188. The hopper dump door switch 184 includes the combination of a hopper door open-closed solenoid valve 192 and a check valve 194 for controlling the opening and closing of the hopper door via a hopper door cylinder 190. The hopper dump door switch 184 functions as a two-position rocker switch having a front "door open" position and a rear "off" position, where the switch is spring loaded to the "off" position. There is no "door closed" position.

Pressing and holding the front of the first squeegee switch 180 causes the solenoid-operated latch to release and raise the two squeegee lift arms 78*a* and 78*b*. Squeegee 44 can be raised to its full height, where it can be stopped at any desired intermediate height by releasing the first squeegee switch 180. A pilot-operated check valve 174 maintains the squeegee lift arm assembly in place when raised. Pressing and holding the rear of the first switch 180 lowers the squeegee lift arms 78*a*, 78*b*.

Pressing and holding the front of the second hopper switch 182 causes the solenoid-operated latch to release and raise the squeegee lift arms 78*a* and 78*b*. The squeegee 44 can be raised to its full height, or can be stopped at any intermediate height by releasing the second hopper switch 182, with a pilot-operated check valve 191 which holds the squeegee lift arm assembly in place when raised. Pressing and holding the rear of the first squeegee switch 180 lowers the squeegee lift arms.

Placing and holding the front of the third hopper door switch 184 for three seconds opens the dump door 30*a* of the hopper 30. This switch is used only for emptying the contents of the hopper 30. The remaining hopper dump door operation is automatic, with the dump door always automatically opened during scrubbing operations. Just before the hopper lift arm assembly begins to raise, the hopper dump door 38 automatically closes. If the hopper contents are emptied such as by pressing the front of the third hopper door switch 184, the hopper door will remain open when lowered. If the hopper 30 is lowered without opening the hopper door 30*a*, the door will be automatically opened by the tilt switch.

The safety pins 96 described above should always be inserted into the telescoping tubes 76*a* and 78*b* when working under, or around, the raised squeegee 44 or debris hopper 30. After raising the squeegee 44 and debris hopper 30 to the desired height, the safety pins 96 should be removed from a support bracket 204 and they should be inserted into an appropriate pair of apertures within the telescoping tube depending upon the raised height of the squeegee and debris hopper, i.e., a lower "maintenance" position, a medium height position, or the fully raised position. It is not necessary to "lock" the safety pin 96 in place by lowering the squeegee 44 or debris hopper onto the safety pin. However, if the squeegee or hopper lift arms are lowered onto a pair of the safety pins, relief valves prevent the hopper and squeegee hydraulic cylinders 76*b* and 78*a* from causing any damage to the hopper or squeegee lift arms, or to any adjacent structure.

The dual lift arm system for the hopper and squeegee of a mobile floor scrubber sweeper disclosed herein has the substantial advantage of providing the operator and a maintenance person with the ability to raise, or partially raise, only the squeegee assembly. The squeegee 44 is the key element in removing solution from the floor, and as such, requires specific attention. Being able to raise only the squeegee 44 without moving the debris hopper 30 provides heretofore unmatched and unavailable clear open access to the squeegee and associated components for inspection, adjustment, maintenance or replacement of the squeegee.

While particular embodiments of the present invention have been described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper prospective based on the prior art.

The invention claimed is:

1. A mobile floor scrubber sweeper apparatus for collecting and discharging debris removed from a floor into a high dumpster, said mobile floor scrubber sweeper apparatus comprising:

a cleaning fluid discharge arrangement for depositing a cleaning fluid on the floor;

at least one brush disposed aft of said cleaning fluid discharge arrangement and engaging the floor for collecting and rearwardly directing debris and cleaning fluid;

a hopper disposed aft of said at least one brush and adapted to receive and retain cleaning fluid and debris from the floor directed rearwardly by said at least one brush;

a squeegee disposed aft of said hopper and engaging the floor for further removing cleaning fluid from the floor and directing the removed cleaning fluid to a reclaimed dirty solution tank within the mobile floor scrubber sweeper;

a first support/positioning arrangement attached to said hopper for moving said hopper between a first lowered operating position, wherein said hopper is in position to receive cleaning fluid and debris from said at least one brush, and a first elevated position for depositing the cleaning fluid and debris into a dumpster; and a second support/positioning arrangement attached to said squeegee for moving said squeegee between a second lowered operating position, wherein said squeegee is in contact with the floor, and a second elevated position to facilitate servicing or replacement of said squeegee, wherein said first and second support/positioning arrangements operate independently and separate from one another, and said first and second elevated positions are vertically spaced from one another.

2. The apparatus of claim 1, wherein each of said first and second support/positioning arrangements is pivotally coupled to an aft portion of the mobile floor scrubber sweeper apparatus.

3. The apparatus of claim 2, wherein said first and second support/positioning arrangements each include a respective upper portion and a respective lower portion, where each upper portion is pivotally coupled to said hopper and to an upper, aft portion of the mobile floor scrubber sweeper apparatus, and each lower portion is coupled to its associated upper portion and to a lower, aft portion of the mobile floor scrubber sweeper apparatus and includes respective first and second displacement means for raising and lowering said hopper and said squeegee.

4. The apparatus of claim 2 having first and second pivot coupling members respectively disposed on right and left lateral aft portions of said apparatus, wherein said first and second support/positioning arrangements are pivotally coupled to said apparatus by said first and second pivot coupling members.

5. The apparatus of claim 3, wherein the respective upper portions of each of the first and second support/positioning arrangements are disposed in closely spaced, parallel relation with one another with said hopper and squeegee either in an operating, use position or in a fully elevated position.

6. The apparatus of claim 3, wherein the respective upper portions of each of said first and second support/positioning arrangements are disposed in close proximity to an aft portion of the mobile floor scrubber sweeper apparatus when said hopper and squeegee are in an operating, use position when cleaning a floor.

7. The apparatus of claim 1, wherein said first support/positioning arrangement includes a first pair of spaced support arms coupled to said hopper and said second support/positioning arrangement includes a second pair of spaced support arms coupled to said squeegee.

8. The apparatus of claim 7 further comprising first and second displacement means coupled to the scrubber sweeper apparatus, and further respectively coupled to said first pair of spaced support arms and to said second pair of spaced support arms.

9. The apparatus of claim 8, wherein said first displacement means includes a first hydraulic cylinder coupled between the scrubber sweeper apparatus and one of said first pair of spaced support arms for raising and lowering said hopper, and said second displacement means includes a second hydraulic cylinder coupled between the scrubber sweeper apparatus and one of said second pair of spaced support arms for raising and lowering said squeegee.

10. The apparatus of claim 9, wherein each of said first pair of spaced support arms and each of said second pair of spaced support arms is pivotally coupled to an aft portion of the mobile floor scrubber sweeper apparatus.

11. The apparatus of claim 9, wherein each of said first and second displacement means is further coupled to a lower aft portion of said mobile floor scrubber sweeper apparatus.

12. The apparatus of claim 11, wherein each of said first and second displacement means includes a respective first hydraulic cylinder coupled to said hopper or to said squeegee, and a second telescoping tube coupled to said hopper or to said squeegee.

13. The apparatus of claim 12, wherein each of said first hydraulic cylinders is coupled to a first end portion of said hopper or of said squeegee, and each of said second telescoping tubes is coupled to a second end portion of said hopper or of said squeegee.

14. The apparatus of claim 13, wherein each of said second telescoping tubes includes, in combination, an inner tube and an outer tube coupled together in a sliding manner, and wherein each of said inner and outer tubes includes respective first and second sets of linearly aligned apertures, wherein with a first aperture of the first set of apertures aligned with the second aperture of said second set of apertures, the first and second aligned apertures are adapted to receive a removable locking pin to securely maintain said hopper or said squeegee in a fixed elevated position.

15. The apparatus of claim 14 further comprising a support bracket coupled to each of said first and second telescoping tubes for receiving and providing fixed storage positioning for a respective locking pin when the locking pin is not coupled to the inner and outer tubes of a telescoping tube.

16. The apparatus of claim 7, wherein said first pair of hopper spaced support arms are disposed outwardly from said second pair of squeegee spaced support arms relative to the floor scrubber sweeper apparatus to allow said hopper and squeegee to pass one another during raising and lowering of the hopper and squeegee.

17. The apparatus of claim 7, wherein said first pair of hopper support arms and said second pair of squeegee support arms are disposed in spaced relation from one another relative to the floor scrubber sweeper apparatus when said first and second support arms are in fixed position or are in motion.

18. The apparatus of claim 1, wherein said hopper includes a door and means for moving said door between a closed position for retaining floor debris in said hopper during operation and an open position for discharging floor debris from said hopper.

19. The apparatus of claim 18, wherein said means for moving said hopper door includes a hydraulic cylinder for automatically maintaining said door open during floor cleaning and for opening said door to permit debris to be discharged from the hopper when said hopper is fully elevated, and for automatically closing said door during transit between the lowered operating position and the elevated debris discharge position.

20. The apparatus of claim 18, wherein said hopper further includes a seal disposed on an outer edge of the hopper's door to prevent debris leakage from the hopper.

* * * * *